United States Patent [19]

Ishikawa

[11] Patent Number: 4,665,291

[45] **Date of Patent: * May 12, 1987**

[54] TEMPERATURE CONTROL SWITCH

[75] Inventor: Seiji Ishikawa, Toyota, Japan

[73] Assignee: Toyota Jidosha Kabushiki Kaisha, Japan

[ * ] Notice: The portion of the term of this patent subsequent to May 20, 2003 has been disclaimed.

[21] Appl. No.: 735,063

[22] Filed: May 17, 1985

[30] Foreign Application Priority Data

May 17, 1984 [JP] Japan ..... 59-99385

[51] Int. Cl.[4] ..... H01H 9/00

[52] U.S. Cl. ..... 200/308; 200/340; 200/5 E; 340/407; 116/205; 116/DIG. 17; 165/11.1; 236/94

[58] Field of Search ..... 200/308, 329, 340, 314, 200/5 E, 5 A; 340/407; 116/205, 279, 307, DIG. 17, DIG. 28; 165/11.1; 236/94, 62.3; 434/112

[56] References Cited

U.S. PATENT DOCUMENTS

| | | | |
|---|---|---|---|
| 2,581,207 | 1/1952 | Sambleson | 200/308 |
| 2,780,801 | 2/1957 | Tyler | 200/314 |
| 3,053,337 | 9/1962 | Prohaska et al. | 200/308 |
| 3,504,140 | 3/1970 | Atkinson | 200/329 |
| 4,435,091 | 3/1984 | Nedreski | 73/336.5 |
| 4,589,593 | 5/1986 | Ishikawa et al. | 236/94 |

FOREIGN PATENT DOCUMENTS

| | | | |
|---|---|---|---|
| 55-51838 | 10/1980 | Japan . | |
| 521607 | 7/1976 | U.S.S.R. | 340/407 |

*Primary Examiner*—Stephen Marcus
*Assistant Examiner*—Linda J. Sholl
*Attorney, Agent, or Firm*—Finnegan, Henderson, Farabow, Garrett & Dunner

[57] ABSTRACT

Control knob for temperature control switch is provided with means for heating or/and cooling the same, whereby, by feeling of the temperature of the control knob with a finger tip, it is possible to instantaneously identify what the function of the control knob which the finger has toughed is, without turning the sight to a switch, and, even when the shapes and way of disposition of control knobs are identical with one another.

6 Claims, 9 Drawing Figures

TEMPERATURE CONTROL SWITCH

BACKGROUND OF THE INVENTION

1. Field of the Invention

This invention relates to temperature control switches, and more particularly, a temperature control switch suitable for use as a switch for controlling a target temperature of an air conditioner in a vehicle such as a motor vehicle, wherein the control knob can be readily identified.

2. Description of the Prior Art

In a vehicle such as a motor vehicle, switches for controlling loads of various lamps, an air conditioner and the like are provided at positions where, particularly, a driver can easily operate, and, when the driver desires to operate or control one of the loads, he operates the switch upon identifying it. However, in order to further facilitate the operation of the vehicles, recently, there is a trend toward an increased number of various switches, and, there is a possibility of becoming difficult to identify the switch with the increase of the number of the switches.

Now, to facilitate the identification of a switch, as shown in FIGS. 8 and 9, there has been made such a proposal that control knobs 12, 14 and 16 disposed on a plate 11 of a switch 10 are changed in shape and way of disposition, whereby, even if a driver does not look at the control knob directly, it becomes possible for him to perceive differences in shape or position of one of the control knobs when he touches it and to identify the function of the control knob which he has touched, so that he can readily select the control knob which he desires to operate.

As a switch in which a control knob can be identified by a picture identification method, in Japanese Utility Model Laid-open No. 51838/1980 for example, there has been made a proposal, wherein, in a switch device provided with a light emitting member which emits a light when a switch portion in a picture showing a vehicle drawn on a flexible indication plate is pressed, a portion of the light emitting member is projected from the aforesaid switch portion on the flexible indication plate to thereby facilitate the switch operation when the switch device is controlled.

However, there has heretofore been presented such a problem that, unless the driver becomes satisfactorily familiar with the shapes or way of disposition of the control knobs, he may make mistakes in selecting or discriminating the control knob.

SUMMARY OF THE INVENTION

The present invention has been developed to obviate the above-described disadvantages of the prior art and has as its object the provision of a temperature control switch, wherein, even if the control knobs are identical in shape and way of disposition with one another, a mere touch by a finger tip of an operator makes it possible for him to identify control knobs so that he can operate the control knob by groping without turning his sight to the switch.

To this end, the present invention contemplates that, in a temperature control switch, as the gist thereof is shown in FIG. 1, the switch includes a control knob for controlling temperature, a contact point on-off operated through the control of the control knob and means for heating or/and cooling the control knob.

A specific form of the present invention is of such an arrangement that the control knob is formed of a highly heat conductive material and the control knob is subjected to a thin and highly durable surface treatment, whereby the means for heating or/and cooling is reduced in capacity, so that the temperature control switch can be easily made compact in size.

Another specific form of the present invention is of such an arrangement that the temperature of the control knob is controlled to a predetermined value in association with the temperature controlled by the control knob, so that the control knob can be reliably identified irrespective of a change in the ambient temperature or the like.

A further specific form of the present invention is of such an arrangement that the means for heating the control knob is made to be a heater disposed close to the rear surface of the control knob, so that the switch can be made light in weight and compact in size.

A still further specific form of the present invention is of such an arrangement that the means for cooling the control knob is made to be an electronic cooling device disposed close to the rear surface of the control knob, so that the switch can be made light in weight and compact in size, similarly to the above.

A still further specific form of the present invention is of such an arrangement that the control knob is made to be knobs for presetting temperatures of an air conditioner including a control knob for elevating a preset temperature and a control knob for lowering a preset temperature, to thereby facilitate the discrimination of the control knobs.

A still further specific form of the present invention is of such an arrangement that the control knob for elevating a preset temperature is held at a predetermined temperature higher than the normal temperature, so that the control knob can be very easily discriminated by the natural feeling of the operator.

A still further specific form of the present invention is of such an arrangement that the control knob for lowering a preset temperature is held at a predetermined temperature lower than the normal temperature, so that the control knob can be very easily discriminated by the natural feeling of the operator, similarly to the above.

A still further specific form of the present invention is of such an arrangement that the shapes and/or way of disposition of the control knobs are made to be different ones in association with the temperatures of heating or/and cooling of the control knobs, so that the control knobs can be discriminated further easier.

A yet further specific form of the present invention is of such an arrangement that patterns discernible by the sense of touch are formed on the surface of the control knobs, so that the control knobs can be discriminated further easier.

According to the present invention, there is provided means for heating or/and cooling the control knob, so that the temperature is felt by the finger tip to thereby instantaneously identify what the switch which the finger tip has touched is, with no need of turning the sight toward the switch. In consequence, the identification of a control knob becomes easier when the control knobs are identical in shape and way of disposition with one another, and moreover, it becomes possible to operate by the groping. Therefore, the control during operation of the vehicle can be made properly and accurately, and moreover, even a person who has trouble in eyes can easily operate the switch.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the embodiments of the control switch of an air conditioner, to which the present invention is applied.

Figure 1:
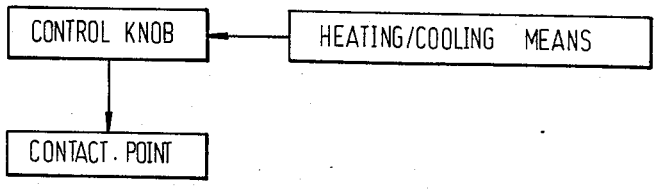
FIG. 1 is a block diagram showing the outline of the arrangement of the temperature control switch according to the present invention.
Figure 2:
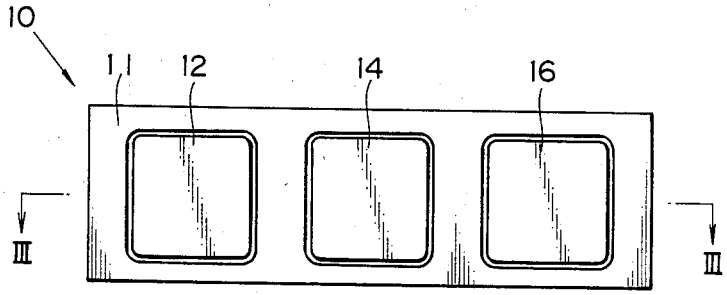
FIG. 2 is a front view showing an arrangement of a first embodiment of the control switch of the air conditioner, to which the present invention is applied.
Figure 3:
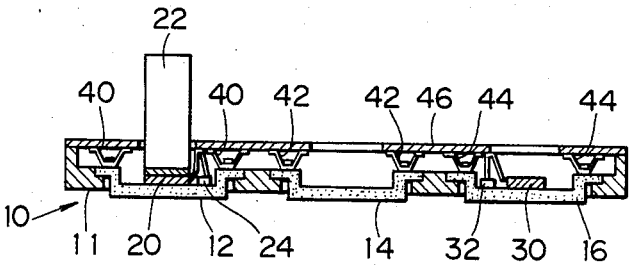
FIG. 3 is a longitudinal sectional view taken along the line III—III in FIG. 2.

As shown in FIGS. 2 and 3, according to the first embodiment of the present invention, the present invention is applied to a control switch 10 of an air conditioner, wherein three control knobs 12, 14 and 16 (designated at 12 is a control knob for lowering a preset temperature, 14 a control knob for on-off operating an air conditioner and 16 a control knob for elevating a preset temperature), all of which have shapes (substantially regular squares) identical with one another, are disposed side by side.

Both the control knob 12 for lowering a preset temperature and the control knob 16 for elevating a preset temperature are formed of a highly heat conductive material such for example as metal like aluminum and the like, and the surfaces of the knobs are subjected to thin and highly durable surface treatment such for example as plating, heated painting and the like, so as to obtain a high heat conductivity.

On the other hand, the control knob 14 for on-off operating an air conditioner to be maintained in the normal temperature conditions is formed of an ordinary material such as resin.

An electronic cooling device 20 such as a thermomodule is disposed close to the rear surface of the control knob 12 for lowering a preset temperature. When electric current is supplied to this electronic cooling device 20, heat is taken away from the control knob 12 for lowering a preset temperature and the heat is transferred to a radiating fin 22. Disposed close to the rear surface of this control knob 12 for lowering a preset temperature is a thermistor 24 for detecting the temperature of this control knob 12, which is utilized for automatically controlling a cooling temperature of this control knob 12 for lowering a preset temperature. In consequence, this control knob 12 for lowering a preset temperature is constantly held at a predetermined temperature lower than the normal temperature in association with its function of lowering a preset temperature of the air conditioner.

On the other hand, a heater 30 is disposed close to the rear surface of the control knob 16 for elevating a preset temperature. When supplied with electric current, this heater 30 generates heat to heat the control knob 16 for elevating a preset temperature. Also, disposed close to the rear surface of this control knob 16 for elevating a preset temperature is a thermistor 32, which is used for automatically controlling a heating temperature of the control knob 16 for elevating a preset temperature. In consequence, this control knob 16 for elevating a preset temperature is constantly held at a predetermined temperature higher than the normal temperature in association with its function of elevating a preset temperature of the air conditioner.

As against the above, to the control knob 14 for on-off operating an air conditioner, constituting a main switch for on-off operating the air conditioner, is not performed any temperature control, and consequently, the control knob 14 is held at the normal temperature conditions.

In FIG. 3, designated at 40, 42 and 44 are rubber contact points which put print patterns arranged on a printed circuit board 46 into conduction by being pressed by the control knobs 12, 14 and 16, respectively. Here, the reason why respective two rubber contact points 40, 42 and 44 are provided on every each one of control knobs 12, 14 and 16 is to try to balance the loads of the control knobs 12, 14 and 16, however, one rubber contact point may be provided on each control knob.

Figure 4:
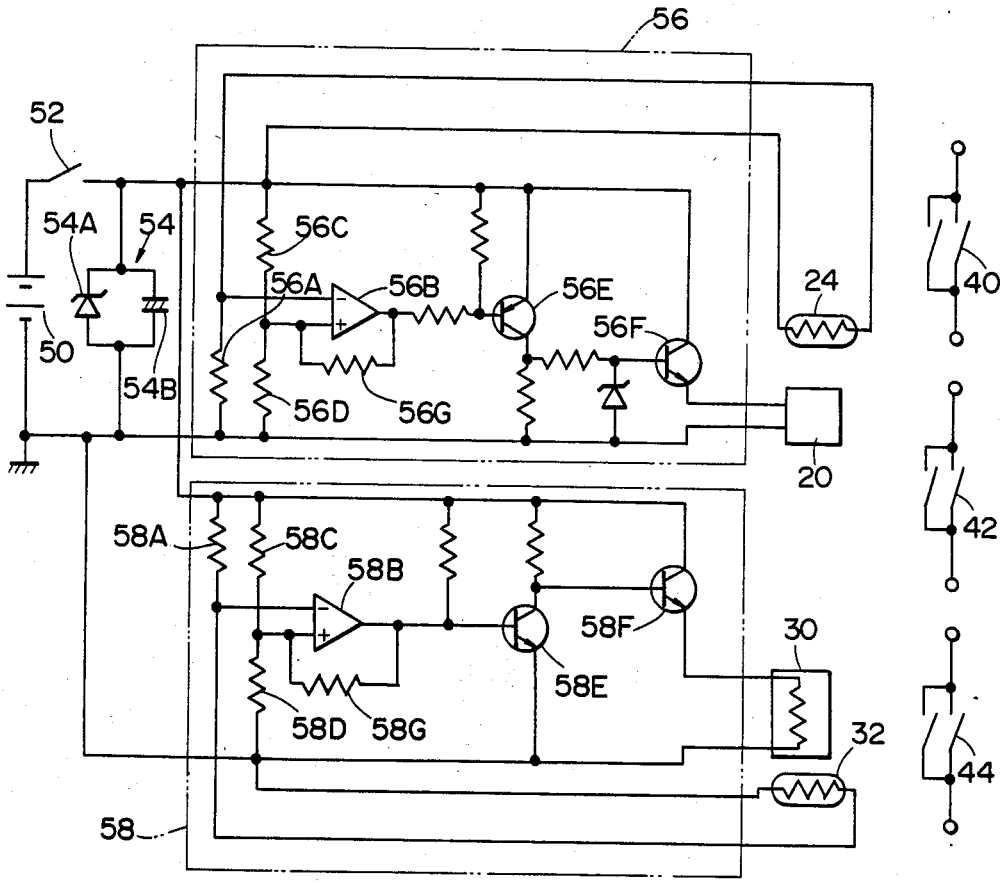
FIG. 4 is a circuit diagram showing the arrangement of the control device used in the first embodiment.

FIG. 4 shows the control device in the first embodiment.

This control device principally includes:

a battery 50;

an ignition switch 52;

a noise absorbing circuit 54;

a cooling temperature control circuit 56 for controlling a current supplied to the electronic cooling device 20 so that a temperature of the control knob 12 for lowering a preset temperature, detected by the thermistor 24, can be a predetermined temperature; and a heating temperature control circuit 58 for controlling a current supplied to the heater 30 so that a temperature of the control knob 16 for elevating a preset temperature, detected by the thermistor 32, can be a predetermined temperature.

This control device is actuated by the applying of a voltage from the battery 50 to the cooling temperature control circuit 56 and the heating temperature control circuit 58 through the ignition switch 52.

The noise absorbing circuit 54 is constituted by a Zener diode 54A and a capacitor 54B, which are parallelly connected, and has a function of absorbing noises to prevent a malfunction caused by the noises.

The cooling temperature control circuit 56 is actuated in the following manner. Namely, the thermistor 24 is varied in resistance value by the temperature of the control knob 12 for lowering a preset temperature, whereby a voltage divided by this thermistor 24 and a resistor 56A is applied to a minus terminal of a comparator 56B. On the other hand, a reference voltage divided by resistors 56C and 56D is applied to a plus terminal of the comparator 56B. Now, when the temperature of the control knob 12 for lowering a preset temperature is higher than the predetermined temperature, a resistance value of the thermistor 24 is lower than the reference value, whereby a voltage higher than the reference voltage is applied to the minus terminal of the comparator 56B. In consequence, an output from the comparator 56B comes to be a low voltage, whereby a transistor 56E is turned on and an output transistor 56F is turned on too. In consequence, a current is supplied to the electronic cooling device 20, whereby the control knob 12 for lowering a preset temperature is cooled. On the other hand, when the control knob 12 for lowering a preset temperature is cooled, whereby the resistance value of the thermistor 24 is increased and a voltage lower than the reference voltage is applied to the minus terminal of the comparator 56B, the output from the comparator 56B comes to be a high voltage. In consequence, both the transistor 56E and an output transistor 56F are turned off. In consequence, the current supplied to the electronic cooling device 20 is cut off, whereby the cooling of the control knob 12 for lowering a preset temperature is stopped. By repeating the above-described processes, the temperature of the control knob 12 for lowering a preset temperature is held at the predetermined temperature lower than the normal temperature. A feedback resistor 56G in the comparator 56B of this cooling temperature control circuit 56 is aimed at providing a hysteresis in switching the comparator 56B.

On the other hand, the heating temperature control circuit 58 is actuated in the following manner. Namely, the thermistor 32 is varied in resistance value by the temperature of the control knob 16 for elevating a preset temperature, whereby a voltage divided by the thermistor 32 and a resistor 58A is applied to a minus terminal of a comparator 58B. On the other hand, a reference voltage divided by resistors 58C and 58D is applied to a plus terminal of the comparator 58B. Now, when the temperature of the control knob 16 for elevating a preset temperature is lower than the predetermined temperature, a resistance value of the thermistor 32 is higher than the reference value, whereby a voltage higher than the reference voltage is applied to the minus terminal of the comparator 58B. In consequence, an output from the comparator 58B comes to be a low voltage, whereby a transistor 58E is turned off, while an output transistor 58F is turned on. In consequence, a current is supplied to the heater 30 to heat the control knob 16 for elevating a preset temperature. On the other hand, when the control knob 16 for elevating a preset temperature is heated, whereby the resistance value of the thermistor 32 is lowered and a voltage lower than the reference voltage is applied to the minus terminal of the comparator 58B, the output from the comparator 58B comes to be a high voltage. In consequence, the transistor 58E is turned on, while the output transistor 58F is turned off. In consequence, the current supplied to the heater 30 is cut off, whereby the heating of the control knob 16 for elevating a preset temperature is stopped. By repeating the above-described processes, the temperature of the control knob 16 for elevating a preset temperature is held at the predetermined temperature higher than the normal temperature. A feedback resistor 58G in the comparator 58B of this heating temperature control circuit 58 is aimed at providing a hysteresis in switching the comparator 58B.

In this embodiment, the shapes and way of disposition of all of the control knobs 12, 14 and 16 are identical in shape and way of disposition with one another, whereby it is easy to make the switch 10 compact in size and the feeling of control is excellent.

Detailed description will hereunder be given of the second embodiment of the present invention.

Figure 5:
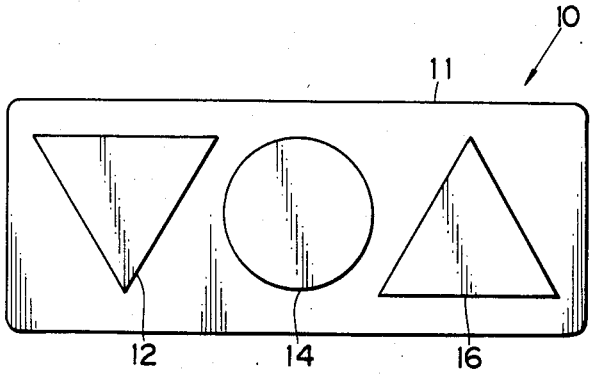
FIG. 5 is a front view showing a second embodiment of the present invention.

According to this embodiment, in a control switch 10 of an air conditioner, including: control knobs 12, 14 and 16; an electronic cooling device 20; a radiating fin 22; thermistors 24 and 32; a heater 30; rubber contact points 40, 42 and 44; a printed circuit board 46; and the like; all of which are similar to those in the first embodiment, as shown in FIG. 5, the control knobs 12, 14 and 16 are varied in shape depending upon control functions of the respective control knobs. For example, the control knob 12 for lowering a preset temperature is formed into a downwardly directed triangular shape, the control knob 14 for on-off operating an air conditioner into a circular shape, and the control knob 16 for elevating a preset temperature into an upwardly directed triangular shape.

This embodiment is identical in other respects with the first embodiment, so that detailed description thereof will not repeated.

In this embodiment, the control knob 12 for lowering a preset temperature is held at the predetermined temperature lower than the normal temperature, the control knob 14 for on-off operating an air conditioner is held at the normal temperature and the control knob 16 for elevating a preset temperature is held at the predetermined temperature higher than the normal temperature, and moreover, the control knobs are different in shape from one another, so that the control knob can be identified further easier. Additionally, when it is difficult to feel the temperature because the finger tip is cold, the control knobs can be identified to some extent because of the difference in shape.

Detailed description will hereunder be given of the third embodiment of the present invention.

Figure 6:
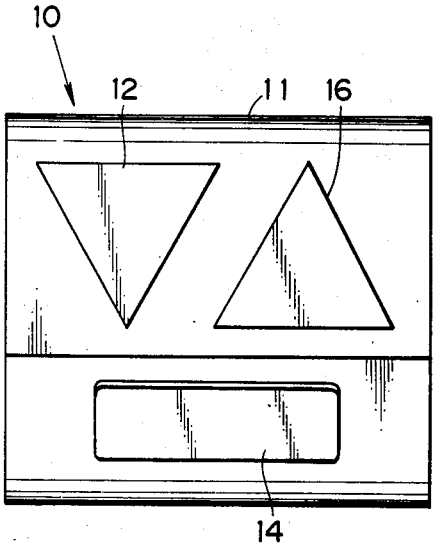
FIG. 6 is a front view showing a third embodiment of the present invention.
Figure 7:
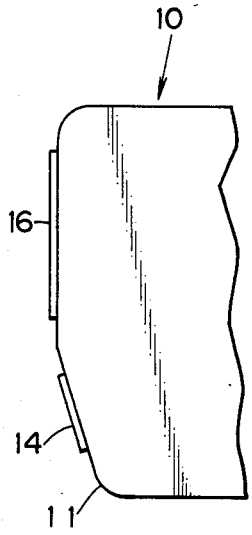
FIG. 7 is a side view thereof.
Figure 8:
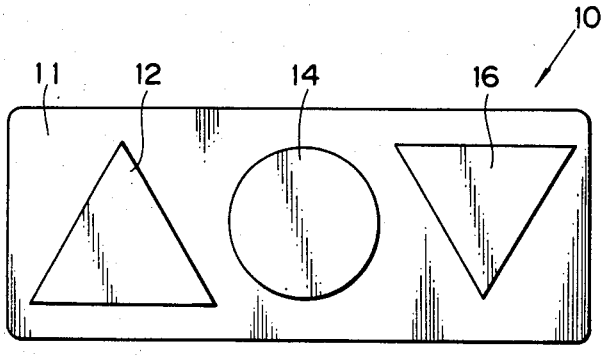
Fig. 8 PRIOR ART
FIG. 8 is a front view showing an example of the conventional switch.
Figure 9:
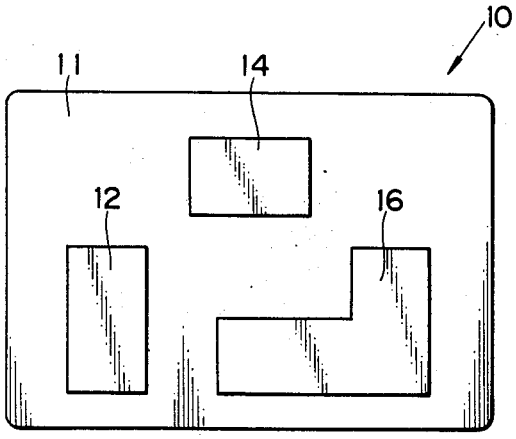
Fig. 9 PRIOR ART
FIG. 9 is a front view showing another example of the conventional switch.

According to this embodiment, in a control switch 10 of an air conditioner, including: control knobs 12, 14 and 16; an electronic cooling device 20; a radiating fin 22; thermistors 24 and 32; heater 30; rubber contact points 40, 42 and 44; a printed circuit board 46; and the like; all of which are similar to those in the first embodiment, as shown in FIGS. 6 and 7, the control knob 12 for lowering a preset temperature is formed into a downwardly directed triangular shape, the control knob 16 for elevating a preset temperature into an upwardly directed triangular shape, and the control knob 14 for on-off operating an air conditioner into a generally rectangular shape, so that it is made possible to identify the control knobs by the shapes, and moreover, the control knob 14 for on-off operating an air conditioner is disposed on a plane different from a plane where the control knob 12 for lowering a preset temperature and the control knob 16 for elevating a preset temperature are disposed.

This embodiment is identical in other respects with the first and second embodiments, so that detailed description thereof will not be repeated.

In this embodiment, the control knob 12 for lowering a preset temperature is held at the predetermined temperature lower than the normal temperature, the control knob 14 for on-off operating an air conditioner is held at the normal temperature, the control knob 16 for elevating a preset temperature is held at the predetermined temperature higher than the normal temperature, the control knobs are differenct in shape form one another, and moreover, the control knobs are different in way of disposition from one another, so that the control knobs can be identified further easier.

Furthermore, in the second or third embodiment, all of control knobs 12, 14 and 16 are varied in total shape depending upon the control functions of the respective control knobs. However, the arrangement, in which the control knobs 12, 14 and 16 are differenct in shape form one another, need not necessarily be limited to this, and, for example, patterns having irregularities thereon for the identification purpose may be formed on the surfaces of the control knobs 12, 14 and 16, so that the irregularities can be discriminated by the sense of touch.

In all of the above embodiment, the present invention is applied to the control switch of the air conditioner, whereby the control knob 12 for lowering a preset temperature is held at the predetermined temperature lower than the normal temperature and the control knob 16 for elevating a preset temperature is held at the predetermined temperature higher than the normal temperature, so that the control knobs can be maintained in the conditions agreeing with the natural feeling of the operator and the control knobs can be very easily identified.

In all of the above embodiments, the electronic cooling device 20 is used as the means for cooling the control knob and the heater 30 is used as the means for heating the control knob, so that the switch can be made light in weight and compact in size. Additionally, the means for cooling or heating the control knob need not necessarily be limited to the electronic cooling device or the heater, and, for example, such an arragement is adoptable that part of air stream blown out of the air conditioner may be utilized to blow cooled air or heated air against the rear surface of the control knob.

Further, in all of the above embodiments, each of the control knobs achieves a single function, so that the temperature control can be easily performed. Further, when it is desired to give a plurality of control functions to a single control knob, predetermined temperatures are changed with every control function, so that the difficulty in identification due to the multiplexing of control functions can be avoided.

Furthermore, in all of the above embodiments, the control knobs 12 and 16 are formed of a metal having high heat conductivity such as aluminum, so that the electronic cooling device 20 and the heater 30 can be low in capacity and compact in size. Additionally, depending upon the capacities of the heating or/and cooling means, shapes of the control knobs and the like, the control knobs 12 and 16 may be formed of a material relatevely low in heat conductively, such as plastics, glass or the like.

What is claimed is:

1. A temperature control switch for controlling the target temperature of a temperature regulating system, comprising:

knob means for selecting said target temperature, said knob means including a control knob member formed of a material having a high thermal conductivity and said control knob member having an inner surface portion; and means for maintaining said knob means at a temperature different from ambient temperature to permit location of said knob means by detecting said different temperature, said temperature maintaining means including an electronic cooling device disposed proximate said inner surface portion of said control knob member.

2. A temperature control switch for controlling the target temperature of a temperature regulating system, comprising:

first knob means for selectively increasing said target temperature;

second knob means for selectively decreasing said target temperature;

first temperature maintaining means for maintaining said first knob means at a temperature higher than ambient temperature to permit location of said first knob means by detecting said higher temperature; and second temperature maintaining means for maintaining said second knob means at a temperature lower than ambient temperature to permit location of said second knob means by detecting said lower temperature.

3. A temperature control switch as set forth in claim 2, wherein said first knob means includes a first control knob member formed of a material having a high thermal conductivity, and said first temperature maintaining means includes a heater proximate said first control knob member.

4. A temperature control switch as set forth in claim 2, wherein said second knob means includes a second control knob member formdd of a material having a high thermal conductivity, and said second temperature maintaining means includes an electronic cooling device proximate said second control knob member.

5. A temperature control switch as set forth in claim 2, wherein said first knob means includes a first control knob member and said second knob means includes a second control knob member, said first and second control knob members having different shapes.

6. A temperature control switch as set forth in claim 2, wherein said first knob means includes a first control knob member having a first surface portion and said second knob means includes a second control knob member having a second surface portion, said first surface portion including first identification irregularities and said second surface portion including second identification irregularities.

* * * * *